US005166577A

United States Patent [19]

Nagao et al.

[11] Patent Number: 5,166,577

[45] Date of Patent: Nov. 24, 1992

[54] PROJECTION CATHODE-RAY TUBE WITH INTERFERENCE FILM

[75] Inventors: Chie Nagao; Noritsuna Hashimoto, both of Amagasaki; Hiroshi Okuda, Nagaokakyo; Yasuo Iwasaki, Nagaokakyo, all of Japan

[73] Assignee: Mitsubishi Denki Kabushiki Kaisha, Tokyo, Japan

[21] Appl. No.: 704,960

[22] Filed: May 23, 1991

[30] Foreign Application Priority Data

May 29, 1990 [JP] Japan ..... 2-138767

[51] Int. Cl.[5] ..... H01J 29/89; H01J 29/28

[52] U.S. Cl. ..... 313/474; 358/253

[58] Field of Search ..... 313/474, 478, 473; 358/253

[56] References Cited

U.S. PATENT DOCUMENTS

| | | | |
|---|---|---|---|
| 2,476,619 | 7/1949 | Nicoll | 313/474 X |
| 3,517,243 | 6/1970 | Jones | 313/473 |
| 4,172,920 | 10/1979 | Kanda et al. | 313/467 X |
| 4,642,695 | 2/1987 | Iwasaki . | |
| 4,772,818 | 9/1988 | Koike et al. | 313/467 |
| 4,804,884 | 2/1989 | Vriens et al. | 313/474 |

FOREIGN PATENT DOCUMENTS

| | | | |
|---|---|---|---|
| 49-43075 | 11/1974 | Japan . | |
| 49-43076 | 11/1974 | Japan . | |
| 0064348 | 5/1980 | Japan | 313/473 |
| 55-150532 | 11/1980 | Japan . | |
| 61-39349 | 2/1986 | Japan . | |
| 61-273837 | 12/1986 | Japan . | |
| 1-95450 | 4/1989 | Japan . | |
| 1-272689 | 10/1989 | Japan . | |

OTHER PUBLICATIONS

"Optimum Arrangement of Phosphor Particles in Cathode-Ray Picture Tube Screens" pp. 894–899, vol. 121, No. 7—Jul. 1974.

"A New Coolant-Sealed CRT for Projection Color TV" IEEE Transaction on Consumer Elec., vol. CE-27; No. 3, Aug., 1981.

*Primary Examiner*—Palmer C. DeMeo

[57] ABSTRACT

A projection cathode-ray tube includes a multilayered interference film interposed between a face plate and a cathode-ray tube. In order to improve brightness in a direction of the normal, then on a face plate, a phosphor layer is composed of a first layer substantially consisting of large size phosphor particles and a second layer substantially consisting of small size phosphor particles. In addition, a phosphor density of the phosphor layer is set from 20 to 50% larger than that necessary to produce a maximum brightness on a cathode-ray tube without the multilayered interference film. The phosphor particles of the phosphor layer are preferably material having a high reflectance.

1 Claim, 5 Drawing Sheets

PROJECTION CATHODE-RAY TUBE WITH INTERFERENCE FILM

BACKGROUND OF THE INVENTION

1. Field of the Invention

This invention relates to a projection cathode-ray tube for use in a projection type television apparatus, and more particularly to an improvement of brightness within small angles to the normal on a display screen of the projection cathode-ray tube. The cathode-ray tube includes an optical multilayered interference film interposed between a face plate and a phosphor screen.

2. Description of the Related Arts

In FIG. 3, a projection television apparatus is diagrammatically illustrated. A projection television apparatus 10 comprises three monochromatic cathode-ray tubes 11 which emit light rays in red, green, and blue, respectively. Monochromatic images produced on a luminescent screen of respective cathode-ray tubes are enlarged and projected on a screen 13, located at a given distance ahead, through projection lens systems 12 disposed in close proximity to the luminescent screen. Thereby, an enlarged color image is reproduced on the screen 13.

FIG. 4 is a partially cutaway sectional side elevation view showing a conventional projection cathode-ray tube. In a cathode-ray tube 11, an inner surface of a face plate 1 is curved towards an evacuated side of the cathode-ray tube. On the inner surface of the face plate 1 are superimposed, one over another, in the order of a multilayered interference film 2, a phosphor layer 3, and a thin aluminum (Al) film 4. The phosphor layer 3 is excited by an electron beam 6 being emitted from an electron gun 5, thereby emanating a monochromatic light.

Japanese Patent Publication Laid-open No. SHO-55-150532 does not disclose a projection cathode-ray tube, but discloses a direct viewing type picture tube comprising a multilayered interference film interposed between a face plate and a phosphor layer. This multilayered interference film is composed of a plurality of layers piled up alternately from an optically transparent material layer having a high refractive index and an optically transparent material layer having a low refractive index.

This interference film allows light rays that are at small angles to the normal pass through, while light rays at large angles to the normal are reflected back towards the phosphor layer.

Thus reflected light rays are again diffusely scattered by phosphor particles, and the light rays reflected within small angles to the normal on the phosphor screen can only travel through the interference film. Accordingly, a halo occurring on the display surface of the cathode-ray tube is prevented.

U.S. Pat. No. 4,642,695 discloses a cathode-ray tube, for use in a projection television apparatus, having a multilayered interference film interposed between the face plate and the phosphor layer. The presence of the interference film results in the convergence of the light rays within +/−30 degrees to the normal on the display surface. As a result, the total quantity of light rays being gathered into the projection lens system is increased, enhancing the brightness on the screen.

Japanese Patent Publication Laid-open No. SHO-61-39349 particularly describes the structure and characteristics of a multilayered interference film for use in a cathode-ray tube, and states that most light rays emitted forwardly of the cathode-ray tube are gathered into a lens system having an acceptance angle between 25 to 30 degrees to the normal on the display screen without any substantial loss.

Further, Japanese Patent Publication Laid-open No. SHO-61-273837 teaches that by using a cathode-ray tube including a face plate having a curvature angle within 5 to 25 degrees to the normal, that is, convex towards the evacuated side of the cathode-ray tube, brightness at the corners and edge of the screen is improved.

Here, the curvature angle is an angle formed between an axis perpendicular to the center of the display screen and a straight line orthogonal to the display screen and located at a distal end from the center of the display screen. In short, the difference in brightness between the periphery and center of the screen can be decreased.

In addition, from Japanese Patent Publication Laid-open No. Hei-1-95450, it is found that since the multilayered interference film can reduce unnecessary components out of the total spectra emanated from the phosphor layer, it becomes possible to change the chromaticity of emitted light from the cathode-ray tube.

As described above, with use of the multilayered interference film, a variety of studies has been made to improve the brightness and chromaticity on the display screen of the projection television apparatus.

Meanwhile, constant efforts have been made to reduce a brightness deterioration with time regarding the structure of the phosphor layer and the shape of the luminescent material of the cathode-ray tube relative to the direct-viewing type cathode-ray tube and the projection cathode-ray tube without the interference film.

A correlation between the thickness of the phosphor layer, the diameter of phosphor particles and brightness is theoretically discussed in an article on pages 894–899 of a journal entitled "J. Electrochem. Soc.: SOLID-STATE SCIENCE AND TECHNOLOGY" Vol. 121, 1974.

In this article, it is described that a maximum brightness is produced when the thickness of the phosphor layer is 1.4 times as thick as the diameter of the phosphor particles. These results are experimentally confirmed in an article on pages 478–485 of a journal entitled "IEEE Transactions on Consumer Electronics" Vol. CE-27, No. 3, August, 1981.

Further, Japanese Patent Publications Laid-open No. SHO-49-43075 and SHO-49-43076 disclose a surface processing technique of phosphor particles consisting of zinc sulphide compounds by the use of a phosphoric compound material and a surface processing technique of phosphor particles consisting of zinc sulphide cadmium compounds by the use of the same material.

These surface processing techniques contribute to the improvement of the dispersibility and adhesiveness of the phosphor particles and the prevention of brightness deterioration of the phosphor layer due to an exposure to heat treatment of manufacturing processes of the cathode-ray tube and due to contamination by impurities.

By virtue of these improvements in brightness and efforts for preventing the brightness deterioration of the cathode-ray tube as being set forth in the above, brightness of the projection televisions of the size of 40" to 70" has been enhanced year by year, whereby an image having sufficient clarity can be reproduced under normal house lighting.

However, in order to realize the screen size of the projection television apparatus up to 100" or more, it may not be said that a sufficient brightness has already been achieved. Accordingly, a proper image cannot be obtained without darkening the room. Namely, brightness of the cathode-ray tube can be improved still further.

SUMMARY OF THE INVENTION

The present invention aims to provide a projection cathode-ray tube with a brightness performance improved in the direction normal to the display screen, and with a consideration of the diffuse reflectance characteristic of the phosphor screen hitherto, unseen in the conventional projection cathode-ray tube.

According to one aspect of the present invention, there is provided a projection cathode-ray tube comprising: a face plate; a multilayered interference film provided on the inner surface of the face plate; a first phosphor layer formed on the multilayered interference film and substantially comprising large size phosphor particles; and a second phosphor layer formed on the first multilayered interference film and substantially comprising small size phosphor particles.

According to another aspect of the present invention, there is provided a projection cathode-ray tube comprising: a face plate; a multilayered interference film formed on the inner surface of the face plate; a phosphor layer formed on the multilayered interference film. A density of the phosphor layer per one unit area is 20% to 50% higher than an optimum density at which the phosphor layer set forth in the above can produce a maximum brightness.

According to still another aspect of the present invention, there is provided a projection cathode-ray tube comprising: a face plate; a multilayered interference film provided on the inner surface of the face plate; and a phosphor layer formed on the multilayered interference film, wherein phosphor particles of the phosphor layer are coated by material having a high reflectance.

According to the present invention, since the diffuse reflectance of the phosphor layer is improved, the loss of diffused light rays on the phosphor side which occur during the multiple reflection between the interference film and the phosphor layer is reduced, and the intensity of light rays enclosing small angles to the normal on the display screen can be improved.

BRIEF DESCRIPTION OF THE ACCOMPANYING DRAWINGS

The novel features believed to be characteristic of the invention are set forth in the appended claims. The invention itself, however, as well as other features and advantages thereof will be best understood by reference to the detailed description which follows, read in conjunction with the accompanying drawings wherein like numerals denote like parts and wherein:

FIG. 1*a* through FIG. 1*c* are fragmentary cross sectional side elevation views showing the structure of screens of projection cathode-ray tubes in accordance with embodiments of the present invention;

DETAILED DESCRIPTION OF THE EMBODIMENTS

With consideration of the diffuse reflectance characteristic which has not been counted in existing cathode-ray tubes, this invention aims at improving brightness within small angles to the normal on a display screen of a projection cathode-ray tube. Accordingly, it is essential to clarify the role of the phosphor layer as being a diffuse reflectance layer rather than the role of the phosphor layer as being a luminescent layer.

In the projection cathode-ray tube having a multilayered interference film interposed between a face plate and the phosphor layer, there occurs a phenomenon which never occurs in a cathode-ray tube without the interference film.

Specifically, light rays emitted within small angles to the normal, coincident with the normal of the interference film on the phosphor layer, travel forwardly passing through the interference film, whereas light rays emitted within large angles to the normal are reflected by the interference film back towards the phosphor layer side.

The light rays reflected by the interference film are again diffusely reflected by the phosphor layer. The light rays diffusely reflected within small angles to the normal on the phosphor layer travel forwardly passing through the interference film whereas the light rays diffusely reflected within large angles to the normal on the phosphor layer are again reflected towards the phosphor layer side.

As a result of such multiple reflections occurring between the interference film and the phosphor layer, the luminous intensity within small angles to the normal on the phosphor layer is increased.

Figure 5:
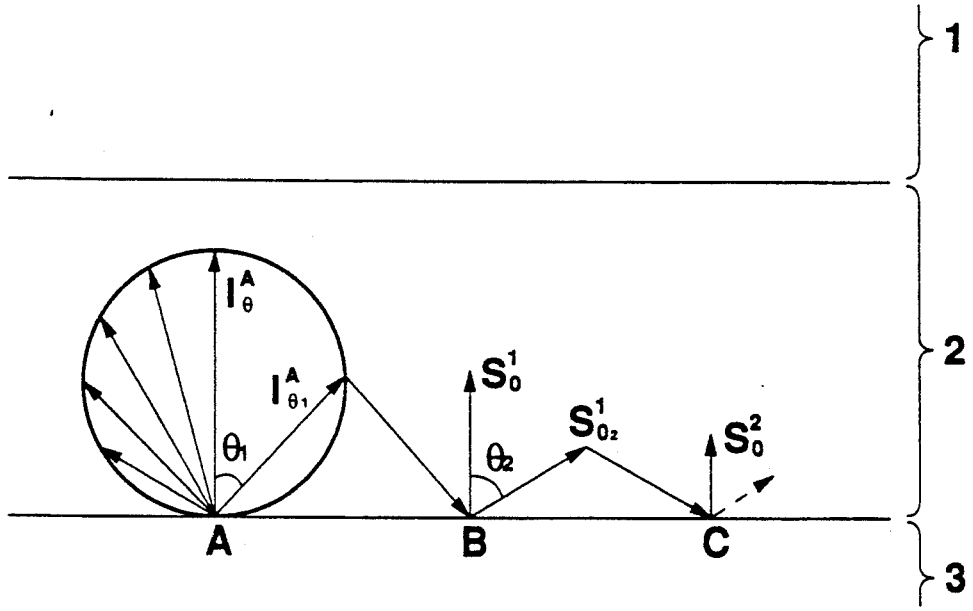
FIG. 5 is a conceptual sectional view for explaining a multiple reflection which occurs between the interference film and a phosphor layer.

Referring to a diagrammatic sectional plan view of FIG. 5, the phenomenon of multiple reflection between the interference film 2 and the phosphor layer 3 will be discussed in detail hereinbelow.

Assuming that a luminous surface is a perfect diffusing surface, a luminous distribution at a point A on the phosphor layer 3 follows Lambert's law. Accordingly, a radiant intensity $I_o^A(\lambda)$ of a wavelength $\lambda$ in an angular direction of $\theta_1$ to the normal on the phosphor layer is obtained by $$I_\theta^A{}_1(\lambda)=I_o^A(\lambda)\cos\theta_1 \quad (1)$$

where $i_o^A(\lambda)$ represents the radiant intensity of the wavelength $\lambda$ in a direction of 0 degree.

By virtue of optical characteristics of the multilayered interference film 2, the emitted light rays enclosing large angles are reflected within the interference film 2 and are again diffusely reflected by the phosphor layer at a point B. Therefore, the radiant intensity $s_o^1(\lambda)$ in the direction of 0 degree at the point B is expressed by a following equation 2.

$$S_0^1(\lambda)=I_\theta^A{}_1(\lambda)\{1-\rho(\theta 1,\lambda)\}R/\pi \quad (2)$$

where $\rho(\theta_1, \lambda)$ represents a transmissivity of the interference film 2 relative to the light rays at the wavelength $\lambda$ having an incident angle $\theta_1$; and R, a diffuse reflectance of the phosphor layer 3 independent of the wavelength.

In addition, at the point B in the direction of 0 degree, the radiant intensity of the light rays reflected by a first interference layer and converged from its omnidirectional orientation to the point B is obtained by $$\begin{aligned} S_0^1(\lambda) &= \phi\, S_0^1(\lambda)\, d\Omega_1 \\ &= I_0^A(\lambda)\, R \int_0^{\pi/2} \sin 2\theta_1 \\ &= \{1 - \rho(\theta_1, \lambda)\}\, d\theta_1 \end{aligned} \tag{3}$$

Likewise, in the direction of 0 degree, the radiant intensity of the light rays reflected n times by the interference film and converged from the omnidirectional orientation to a certain one point is expressed by $$S_0^n(\lambda) = I_0^A(\lambda) \left[ R \int_0^{\pi/2} \sin 2\theta \{1 - \rho(\theta_1, \lambda)\}\, d\theta \right]^n \tag{4}$$

Thus, the radiant intensity $I^0(\lambda)$ in the direction of 0 degree at the arbitrary point is amplified by the multiple reflection between the interference film and the phosphor layer, and can be approximated by $$\begin{aligned} I_0(\lambda) &= I_0^A(\lambda) + S_0^1(\lambda) + S_0^2(\lambda) + \dots \\ &= I_0^A(\lambda)/\{1 - K(\lambda)\} \end{aligned} \tag{5}$$

where $K(\lambda)$ is expressed by $$K(\lambda) = R \int_0^{\pi/2} \sin 2\theta \{1 - \rho(\theta, \lambda)\}\, d\theta \tag{6}$$

Consequently, the luminous intensity distribution of the emitted light rays which passed through the multilayered interference film 2 is given by $$I_\theta(\lambda) = I_0(\lambda) \cos\theta \cdot \rho(\theta, \lambda) \tag{7}$$

Figure 6:
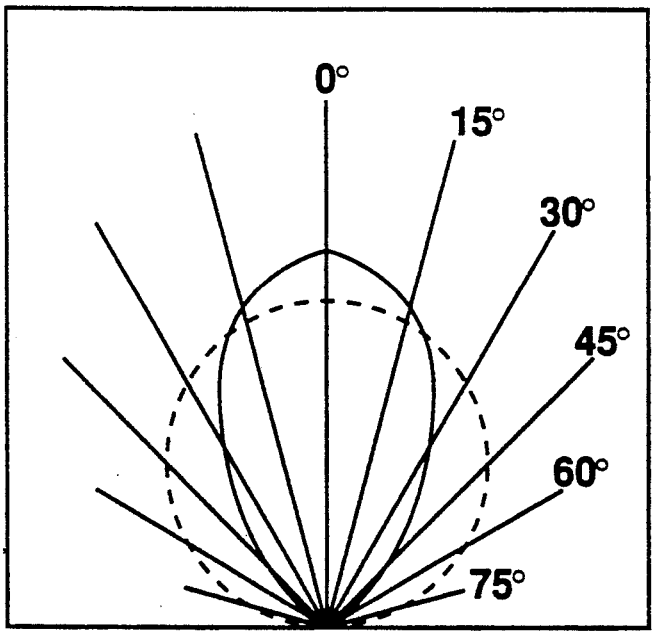
FIG. 6 is an explanatory diagram showing the brightness distribution of a conventional cathode-ray tube having a multilayered interference film.

FIG. 6 illustrates the luminous intensity distribution thus obtained. In FIG. 6, a solid line represents the luminous intensity distribution obtained by the seventh expression involving the multilayered interference film, while a dotted line represents the luminous intensity distribution obtained by the first expression not involving the interference film. From FIG. 6, it can be seen that the light rays emitted from the display screen of the cathode ray-tube 11 are converged into an angular range within +/−30 degrees to the normal. A major factor which contributes to an increase of a light-gathering rate is the diffuse reflectance R of the phosphor layer defined by the second expression. Namely, by improving the diffuse reflectance R of the phosphor 3, it turns out that the intensity of the emitted light rays within small angles to the normal on the display screen of the cathode ray-tube 11 can be improved more than ever.

Figure 1A:
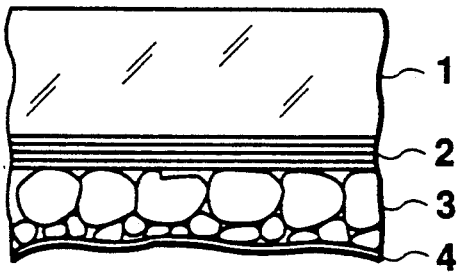

FIG. 1*a* is a fragmentary cross sectional view showing elements of a cathode ray-tube in accordance with one embodiment of the present invention. In the first embodiment, a commercial ZnS: Ag powder (an average particle size of 5 micrometers) is screened, and two types of powder are obtained, that is, a particle size of 1 through 3 micrometers and a particle size of 7 through 10 micrometers. A first phosphor layer is obtained by applying the powder having the size of 7 through 10 micrometers at a phosphor density of 3 mg/cm$^2$ onto the interference film 2 formed on the inner surface of the face plate 1, having the size of 7", by means of a weight sedimentation method. After the first layer has been dried, a second phosphor layer is formed by applying the powder, having the size of 1 through 3 micrometers at a phosphor density of 3 mg/cm$^2$, by means of the same method.

Using a face plate having two thus obtained phosphor layers, a cathode-ray tube comprising electron guns is fabricated. The phosphor layer 3 is illuminated under the conditions of: a positive electrode of 26 kV; an electron-beam current of 100 microampere; a raster size of 40×40 mm$^2$; being in a defocused state, and brightness is measured at every given angle from the normal on the phosphor screen. As a result, there is obtained the luminous intensity distribution designated by the solid curved line A in FIG. 2. In the meantime, for comparison, there is also fabricated a cathode-ray tube including the phosphor layer being composed of the phosphor powder which has been applied onto the interference film 2 at a phosphor density of 6 mg/cm$^2$ without screening. The solid curved line B of FIG. 2 represents the luminous intensity distribution measured on this cathode-ray tube.

Figure 2:
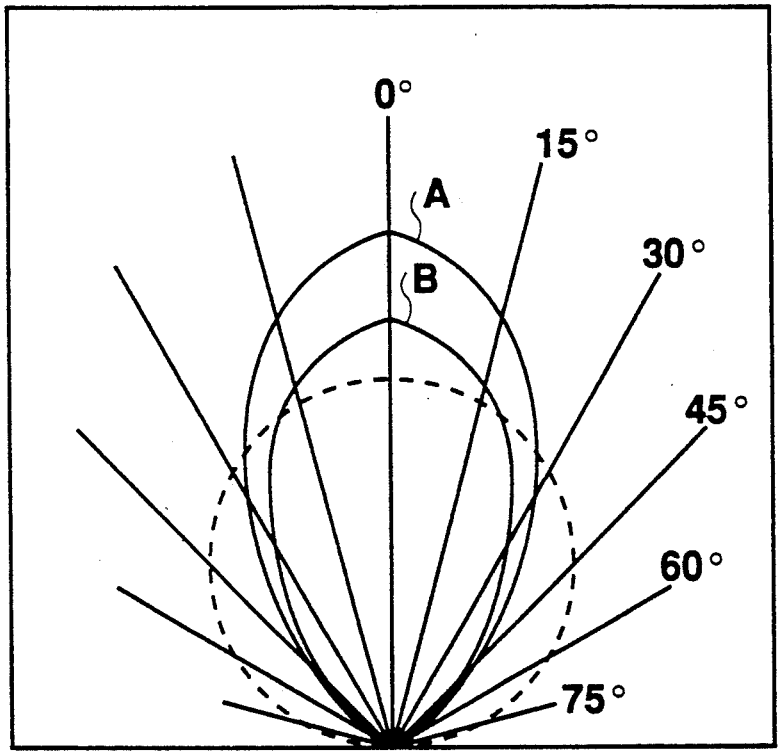
FIG. 2 is a characteristic diagram showing a brightness distribution for explaining a result of this invention.
Figure 3:
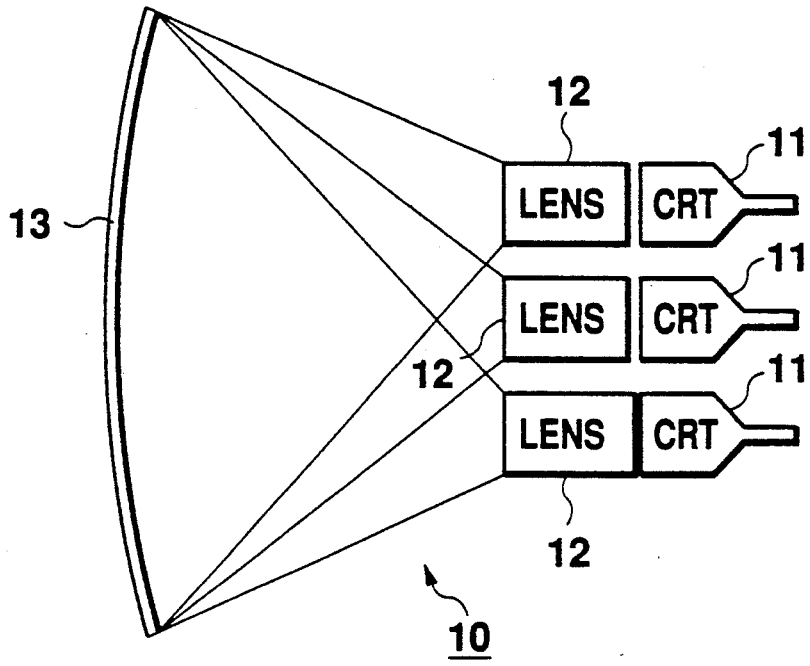
PRIOR ART Fig.3
FIG. 3 is a conceptual view diagrammatically showing the structure of a projection cathode-ray tube.
Figure 4:
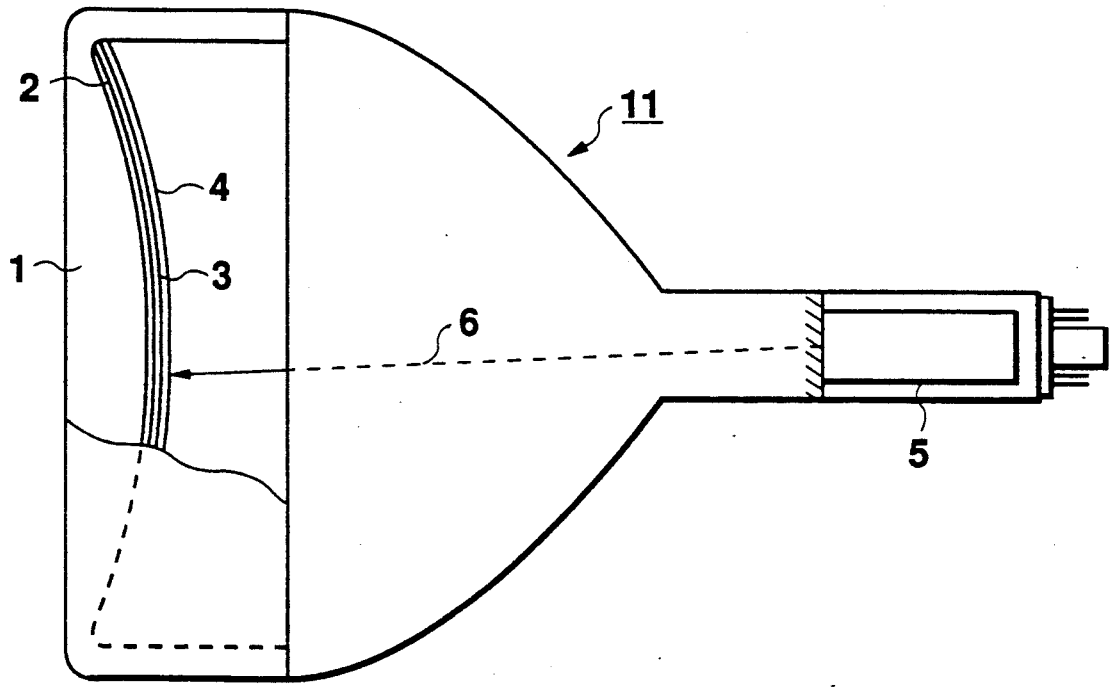
PRIOR ART Fig.4
FIG. 4 is a side elevation partially cutaway view showing a projection cathode-ray tube having a multilayered interference film.

As can be seen from FIG. 2, the intensity of the light rays forwardly emitted from the cathode-ray tube in accordance with the first embodiment are higher than that produced from the latter cathode-ray tube by about 25% in brightness in the direction of the normal.

Figure 1B:
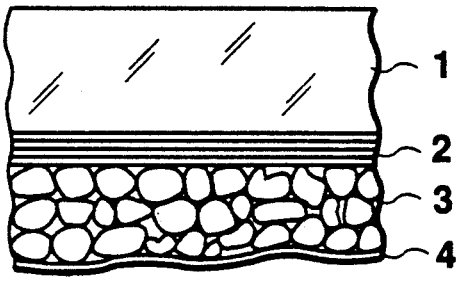

FIG. 1*b* is a fragmentary side sectional view showing the phosphor layer in accordance with a second embodiment of the present invention. In this embodiment, there is fabricated a cathode-ray tube including the phosphor layer 3 composed of a commercial $Gd_2O_2S$: Tb green phosphor which has been applied onto the multilayered interference film at a phosphor density of 8 mg/cm$^2$. For comparison there is also fabricated a cathode-ray tube including the phosphor layer composed of phosphor powder which has been applied onto the interference film at a phosphor density of 6 mg/cm$^2$.

As has been disclosed by the articles of the foregoing journals of "J. Electrochem. Soc.: SOLID-STATE SCIENCE AND TECHNOLOGY" Vol. 121, 1974 pp. 894 to 899 and "IEEE Transactions on Consumer Electronics" Vol. CE-27, No. 3, August, 1981 pp. 478 to 485, in the case of the cathode-ray tube without the interference film, a phosphor density of 5 to 6 mg/cm$^2$ is optimum for the phosphor layer in order to produce a maximum brightness. The cathode-ray tube including the phosphor layer applied at a phosphor density of 8 mg/cm$^2$ in accordance with the second embodiment and the cathode-ray tube including the phosphor layer applied at a phosphor density of 6 mg/cm$^2$ are measured under the same conditions as those in the first embodiment, and it turns out that brightness of the former cathode-ray tube is higher than that of the latter cathode-ray tube by 15%.

Moreover, the brightness measurement carried out again after the successive illumination of both former and latter cathode-ray tubes for 2,000 hours results in that the former cathode-ray tube being superior to the latter one by 10% in brightness maintenance factor. Here, the brightness maintenance factor is the ratio of brightness measured after the 2,000-hour illumination to the initial brightness value.

This is explained by the fact that because of the thickness of the phosphor layer 3 comprised in the cathode-ray tube in accordance with the second embodiment, electron bombardment onto the glass face plate is decreased and consequently it is harder for browning discoloration to occur.

Figure 1C:
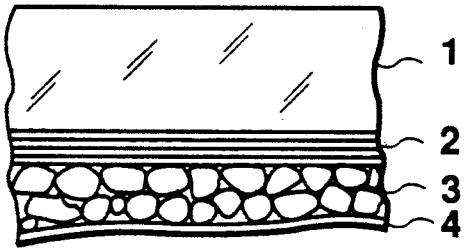

FIG. 1*c* is a fragmentary side sectional view showing a cathode-ray tube in accordance with a third embodiment of the present invention.

In the third embodiment, a commercial ZnS: Cu, Al green phosphor powder is stirred in pure water and subsequently the solution is stirred again with the addition of a given amount of zinc sulfate solution.

With the stirring continued, when a very small amount of a potassium hydroxide solution is added to the solution and the pH of the solution is increased up to about 9, either a zinc oxide or a zinc hydroxide is deposited on the surface of the phosphor particles.

These phosphor particles are heated up to 800 degrees after a purification, and consequently there is produced a phosphor powder coated with zinc oxide.

Using thus obtained phosphor powder, a cathode-ray tube in accordance with a third embodiment of the present invention is fabricated. At that time, for comparison, there is also fabricated a cathode-ray tube by the use of ZnS: Cu, Al phosphor powder not being coated with zinc oxide.

When the brightness is measured in the direction of the normal of each cathode-ray tube, the brightness of the former cathode-ray tube is higher than that of the latter cathode-ray tube by 15%.

As mentioned above, according to the present invention, because of the improvement of the diffuse reflectance of the phosphor layer, the loss of diffused light rays on the phosphor layer side during the multiple reflections between the interference film and the phosphor layer is diminished, thereby enhancing the luminous intensity within small angles to the normal on the display screen of the projection cathode-ray tube. Therefore, brightness on the screen of the projection television apparatus is improved.

While this invention has been described with reference to an illustrative embodiment, this description is not intended to be construed in a limiting sense. Various modifications of the illustrative embodiment, as well as other embodiments of the invention, will be apparent to those who are versed in the art with reference to this description. It is, therefore, contemplated that the appended claims will cover any such modifications or embodiments as fall within the true scope of the invention.

What is claimed is:

1. A projection cathode-ray tube comprising:

(a) a face plate;

(b) a multilayered interference film formed on the inner surface of the face plate; and (c) at least one phosphor layer formed on the multilayered interference film, including phosphor particles coated with zinc oxide, having a reflectance higher than a reflectance of the multilayered interference film.

* * * * *